US006466758B2

(12) United States Patent
Chigono et al.

(10) Patent No.: US 6,466,758 B2
(45) Date of Patent: Oct. 15, 2002

(54) DEVELOPING APPARATUS HAVING FOREIGN MATTER ACCUMULATING SPACE

(75) Inventors: Yasunori Chigono, Susono; Harumi Ishiyama; Jun Hirabayashi, both of Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/793,134

(22) Filed: Feb. 27, 2001

(65) Prior Publication Data

US 2001/0019673 A1 Sep. 6, 2001

(30) Foreign Application Priority Data

Feb. 28, 2000 (JP) ..... 2000-056037

(51) Int. Cl.[7] ..... G03G 15/08
(52) U.S. Cl. ..... 399/253; 399/98; 399/149
(58) Field of Search ..... 399/98, 149, 150, 399/252, 253, 258

(56) References Cited

U.S. PATENT DOCUMENTS 5,283,615 A * 2/1994 Yokoyama et al. ..... 399/253 X
5,561,506 A * 10/1996 Kasahara ..... 399/256
5,802,430 A * 9/1998 Wada ..... 399/253
5,970,279 A * 10/1999 Sakaizawa et al. ..... 399/149 X

FOREIGN PATENT DOCUMENTS

JP 58-072969 * 5/1983
JP 61-228478 * 10/1986
JP 07-104578 * 4/1995
JP 07-152248 * 6/1995

* cited by examiner

*Primary Examiner*—Sophia S. Chen
(74) *Attorney, Agent, or Firm*—Fitzpatrick, Cella, Harper & Scinto

(57) ABSTRACT

A developing apparatus prevents a reduction in image density due to paper powder by providing a developing apparatus that has a developing container, a toner carrying member, and a toner container, wherein the toner container has a space portion, which is disposed below the toner carrying member and which is not substantially replenished with the toner.

8 Claims, 9 Drawing Sheets

FIG. 11

| | DISTANCE BETWEEN CENTER OF SLEEVE AND OPENING PORTION (Dr)mm | MAXIMUM DISTANCE BETWEEN CENTER OF SLEEVE AND INNER WALL OF DEVELOPING ROOM (Er)mm | PRESENCE OF COLLECTING AREA (E) | AUXILIARY MEANS FOR REMOVING PAPER POWDER | DENSITY CHANGE, INITIAL→ AFTER 4k SHEETS | RELATIVE ESTIMATION OF IMAGE UNIFORMITY (AFTER 4k) | RELATIVE ESTIMATION OF PAPER POWDER ON SLEEVE |
|---|---|---|---|---|---|---|---|
| FIRST EMBODIMENT | 12 | 16 | PRESENT | ABSENT | 1.45→1.38 (−0.07) | B | B |
| COMPARATIVE EXAMPLE 1 | 12 | 12 | ABSENT | ABSENT | 1.45→1.25 (−0.20) | C | C |
| SECOND EMBODIMENT | 12 | 16 | PRESENT | REPULSIVE POLE | 1.45→1.41 (−0.04) | B | A |
| COMPARATIVE EXAMPLE 2 | 12 | 12 | ABSENT | REPULSIVE POLE | 1.45→1.23 (−0.22) | C | C |
| THIRD EMBODIMENT | 12 | 16 | PRESENT | MAGNETIC BLADE | 1.45→1.40 (−0.05) | B | A |
| FOURTH EMBODIMENT | 12 | 16 | PRESENT | NON-MAGNETIC STIRRING MEMBER | 1.45→1.37 (−0.08) | B | A |
| FIFTH EMBODIMENT | 12 | 16 | PRESENT | MEMBER FOR REMOVING PAPER POWDER ON DRUM | 1.45→1.35 (−0.10) | A | A |
| SIXTH EMBODIMENT | 12 | 16 | PRESENT | ABSENT | 1.51→1.47 (−0.04) | A | A |
| COMPARATIVE EXAMPLE 3 | 12 | 12 | ABSENT | ABSENT | 1.51→1.38 (−0.13) | C | C |

DEVELOPING APPARATUS HAVING FOREIGN MATTER ACCUMULATING SPACE

BACKGROUND OF THE INVENTION

1. Field of the Invention

The present invention relates to a developing apparatus for developing a latent image on an image bearing member, which is used with an image forming apparatus of electrophotographic type or electrostatic recording type such as a copying machine, a printer and the like.

2. Related Background Art

In image recording apparatuses of a transfer type, after transferring, residual developer (toner) remaining on a photosensitive member (image bearing member) is removed from a surface of the photosensitive member by a cleaner (cleaning apparatus) as waste toner. It is desirable that the waste toner does not escape out of the apparatus from the viewpoint of protection of environment.

To this end, there has been proposed an image recording apparatus having a toner recycle system (or toner recycle process) in which a cleaner is omitted, and, after the transferring, residual toner remaining on a photosensitive member is removed by "cleaning simultaneously with developing" and the removed waste toner is collected in a developing apparatus and is re-used.

The cleaning simultaneous with developing is referred to as a method in which the residual toner remaining on the photosensitive member after the transferring is collected by fog removal bias (having fog removal potential difference of Vback which is potential difference between Av voltage applied to the developing apparatus and surface potential on the photosensitive member) in the subsequent developing process.

According to this method, since the residual toner is collected in the developing apparatus and is re-used in the subsequent process and so on, the waste toner can be eliminated and maintenance can be reduced. Further, since there is no cleaner, space can be saved, thereby making the image recording apparatus substantially more compact.

However, the above-mentioned cleanerless system has the following problem.

That is to say, when the cleanerless system is used, since the toner is recycled without providing the cleaner, foreign matter such as paper powder from a recording paper will enter into the developing device, thereby causing poor image formation.

Such paper powder enters into the developing device during the image recording, which results in reduction of image density and deterioration of uniformity of the image recording having intermediate density.

SUMMARY OF THE INVENTION

An object of the present invention is to provide a developing apparatus which can prevent reduction in image density due to paper powder.

Another object of the present invention is to provide a developing apparatus which can separate foreign matter from toner.

A further object of the present invention is to provide a developing apparatus comprising a developing container, a toner carrying member provided at an opening portion of the developing container and adapted to carry toner, and a toner container disposed adjacent to the developing container and adapted to replenish the developing container with the toner, wherein the toner container has a space portion which disposed below the toner carrying member and which is not substantially replenished with the toner.

The other objects and features of the present invention will be apparent from the following detailed explanation referring to the accompanying drawings.

BRIEF DESCRIPTION OF THE DRAWINGS

FIG. 11 is a table showing an estimation result.

DESCRIPTION OF THE PREFERRED EMBODIMENTS

The present invention will now be explained in connection with embodiments thereof with reference to the accompanying drawings.

(First Embodiment)

A developing apparatus and an image recording apparatus according to a first embodiment of the present invention will now be explained with reference to FIGS. 1 and 2.

Figure 1:
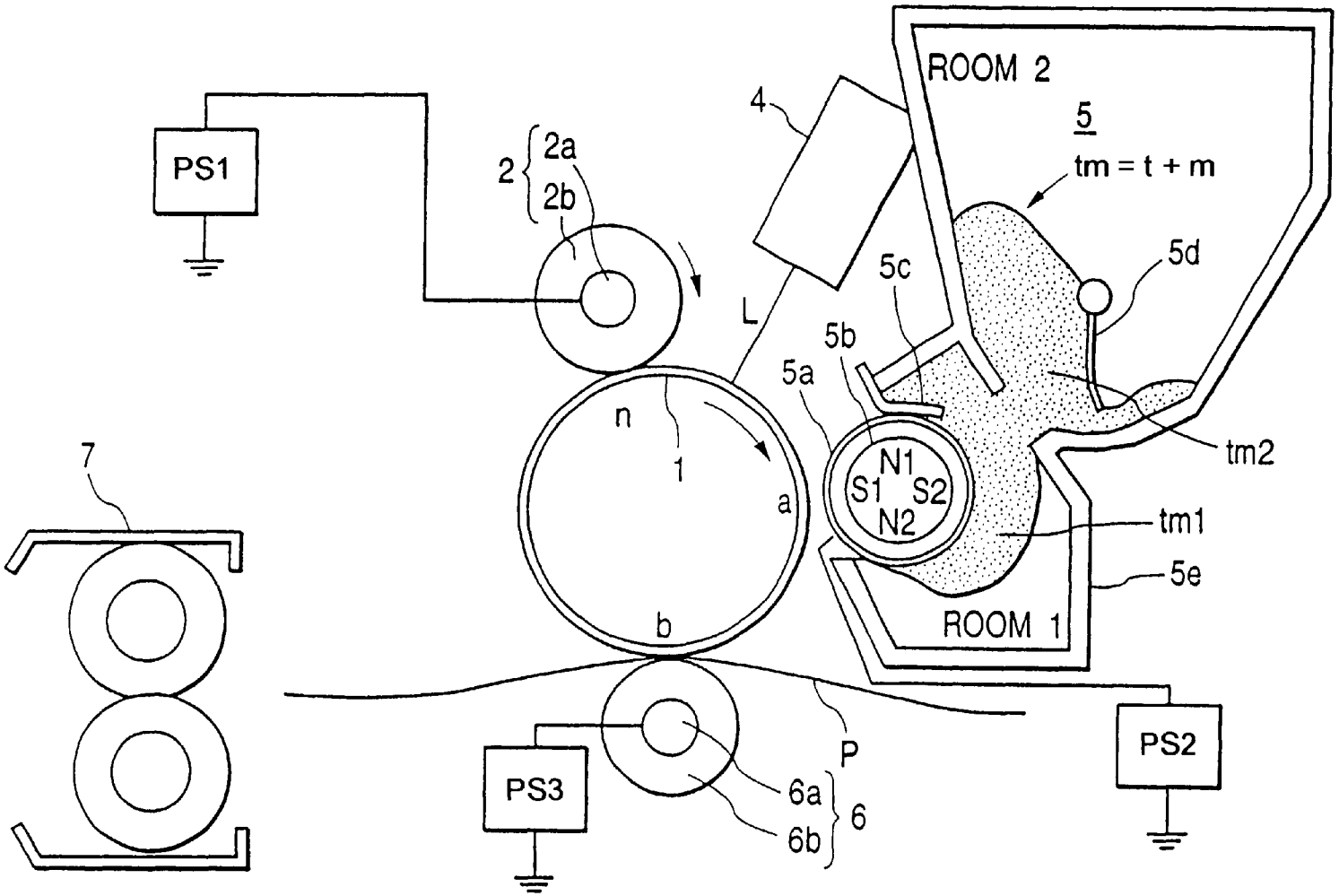
FIG. 1 is a schematic constructural view of an image recording apparatus according to a first embodiment of the present invention.
Figure 2:
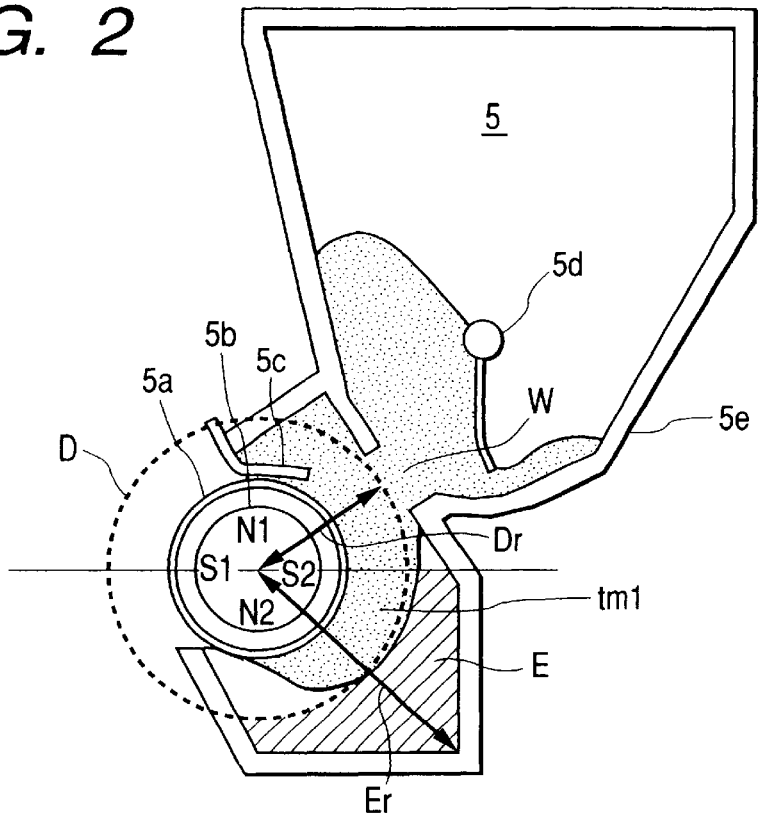
FIG. 2 is a schematic constructural view of a developing apparatus according to a first embodiment of the present invention.

FIG. 1 is a schematic constructural view of an image recording apparatus according to a first embodiment of the present invention, and FIG. 2 is a schematic constructural view of a developing apparatus according to a first embodiment of the present invention.

In the first embodiment, as an example of the image recording apparatus, a laser printer (recording apparatus) utilizing an electrophotographic process of transfer type, a direct charge coupling (charge injection) system and toner recycle process (cleanerless) system will be explained.

(1) Entire Schematic Construction of Printer

In the illustrated embodiment, an image bearing member 1 as a member to be: developer is constituted by a rotatable drum-type negative polarity OPC photosensitive member (negative photosensitive member; referred to as "photosensitive drum" hereinafter) having a diameter of 24 mm (ϕ24). The photosensitive drum 1 is rotated at a constant peripheral speed (process speed PS, and printing speed) of 50 mm/sec in a clockwise direction shown by the arrow.

A charging roller 2 constituting a charging apparatus is a conductive elastic roller as a contact charging member urged against the photosensitive drum 1 with predetermined pressure. The charging roller 2 and the photosensitive drum 1 define a contact portion n therebetween.

The charging roller 2 holds (or carries) conductive particles m (conductive particles for charging purpose) having conductivity at its peripheral surface, and the conductive particles m exist in the charging contact portion n between the photosensitive drum 1 and the charging roller 2.

The charging roller 2 is rotated in a (counter direction) opposite to that of the photosensitive drum 1, so that a speed difference therebetween is created in the charging contact portion n. Further, during the image recording of the printer, predetermined charging bias is applied to the charging roller 2 from a charging bias applying power source PS1.

As a result, the peripheral surface of the rotating photosensitive drum 1 is uniformly contact-charged with a predetermined polarity and potential through a direct injection charging system. In the illustrated embodiment, the applying bias from the applying power source PS1 is selected to be −700 V (DC voltage).

Incidentally, the charging roller 2, conductive particles m and direct injection charging will be described later in detail.

A laser beam scanner (exposing apparatus) 4 including a laser diode, a polygon mirror and the like serves to output a laser beam intensity of which is modulated in response to a time-lapse digital image signal of target image information, so that the uniformly charged surface of the rotating photosensitive drum 1 is subjected to scan exposure L by the laser beam.

As the result of the scan exposure L, an electrostatic latent image corresponding to the target image information is formed on the surface of the photosensitive drum 1.

A developing apparatus 5 serves to develop the electrostatic latent image on the surface of the rotating photosensitive drum 1 as a toner image at a developing portion a.

Mixture tm obtained by adding conductive particles m to developer t is contained within the developing apparatus 5, and the mixture tm is constituted by developing pre-mixture tm1 in a developing room (room 1) of a developing container 5*e* and a replenishing mixture tm2 stored in a toner room (room 2) as a developer room. As the printing operations are repeated, the developing room is replenished with the replenishing mixture tm2 in the toner room. Incidentally, the developing device 5 will be described later in detail.

An intermediate resistance transfer roller 6 as contact type transferring means constituting a transferring apparatus is urged against the photosensitive drum 1 with predetermined pressure, thereby defining a transfer nip portion b therebetween. A transfer material P as a recording medium from a sheet feeding portion (not shown) is fed to the transfer nip portion b at a predetermined timing, and, by applying predetermined transfer bias applying power source PS3, the toner image on the photosensitive drum 1 is transferred onto the transfer material fed to the transfer nip portion b.

The transfer roller 6 used in the illustrated embodiment is constituted by forming an intermediate resistance foam layer 6*b* on a metal core 6*a* to have a roller resistance value of $5\times10^8$ Ω, and the transferring is effected by applying a voltage of +2.0 kV to the metal core 6*a*. The transfer material P introduced into the transfer nip portion b is pinched by and passed through the transfer nip portion b; meanwhile, the toner image borne on the surface of the photosensitive drum 1 is electrostatically transferred onto the surface of the transfer material.

A fixing apparatus 7 of a thermal fixing type is also provided. The transfer material P to which the toner image was transferred from the photosensitive drum 1 in the transfer nip portion b is separated from the rotating photosensitive drum 1 and then is introduced into the fixing apparatus 7, where the toner image is fixed onto the transfer material. Thereafter, the transfer material is discharged out of the printer as an imaged matter (print copy).

The printer according to the illustrated embodiment is of a cleanerless type in which, after the transferring, residual toner remaining on the rotating photosensitive drum 1 is sent to the developing portion a through the charging contact portion n without being removed by an exclusive cleaner (cleaning apparatus) and is collected by cleaning simultaneously with developing in the developing apparatus to be re-used.

(2) Charging Roller 2

In the illustrated embodiment, the charging roller 2 as the contact charging member is constituted by forming an intermediate resistance layer 2*b* made of rubber or foam on a metal core 2*a*.

The intermediate resistance layer 2*b* is prescribed by a resin (for example, urethane), conductive particles (for example, carbon black), a sulfurizing agent and a blowing agent to be formed as a roller shape on the metal core 2*a*. Then, if necessary, the layer is polished to obtain the charging roller 2 (conductive elastic roller) having a diameter of 12 mm and a longitudinal length of 200 mm.

The roller resistance of the charging roller 2 is selected to 100 kΩ. The roller resistance was measured by applying voltage of 100 V between the metal core 2*a* and an aluminium drum having an outer diameter of 30 mm in a condition that the charging roller 2 is urged against the aluminium drum to apply total pressure of 1 kg to the metal core 2*a* of the charging roller 2.

It is important that the charging roller 2 as the contact charging member acts as an electrode. Namely, it is necessary that the charging roller has enough elasticity to establish a good contacting condition between the roller and the member to be charged and a low enough resistance to charge the shifting member.

On the other hand, if the member to be charged has an endurance defect portion such as pin-hole, voltage leak must be prevented. When an electrophotographic photosensitive body is used as the member to be charged, resistance of $10^4$ to $10^7$ Ω is desirable in order to provide good charging ability and good anti-leak ability.

It is desirable that the surface of the charging roller 2 has minute unevenness to hold the conductive particles m thereon.

Further, it is preferable that hardness of the charging roller 2 is in a range between 25 to 50 degrees (Asker C hardness), because, if the hardness is too low, the contact between the member to be charged and the charging roller is worsened due to an unstable configuration, and if, the hardness is too great, not only the contact charging portion n can not be maintained between the member to be charged and the charging roller but also microscopical contacting ability with the member to be charged is worsened.

Material of the charging roller 2 is not limited to elastic foam, and, elastic body may be EPDM, urethane, NBR, silicone rubber, rubber material obtained by dispersing conductive material (such as carbon black or metal oxide) for adjusting the resistance in IR, or foam,thereof.

Further, the resistance may be adjusted by using ion conductive material (without dispersing the conductive material).

The charging roller 2 is urged against the photosensitive drum (member to be charged) with predetermined pressure in opposition to the elasticity, and, in the illustrated embodiment, the charging contact portion having a width of several millimeters is created.

Further, in the illustrated embodiment, the charging roller 2 is rotated in a clockwise direction shown by the arrow at a speed of about 80 rpm so that the surface of the charging roller and the surface of the photosensitive member are shifted in opposite direction at the same speed in the contact charging portion n. That is to say, the surface of the charging roller 2 as the contact charging member has a speed difference with respect to the surface of the photosensitive drum 1 as the member to be charged.

(3) Developing Apparatus 5

The developing apparatus 5 according to the illustrated embodiment is a reversal developing device using one-component magnetic toner (negative toner) as the developer t. The mixture tm of the developer (negative toner) t as magnetic body and the conductive particles m is contained in the developing apparatus.

The developing apparatus includes a rotating nonmagnetic developing sleeve 5*a* as a developer carrying member having a magnet roller (magnetic field generating member) 5*b* therein, which sleeve has poles S1, S2, N1, and N2 and is formed from a cylindrical member) 5*b* therein, so that the toner t in the developing pore-mixture tm1 is formed as a toner layer and is subjected to tribo-electricity by a regulating blade 5*c* as the toner is being carried on the rotating developing sleeve 5*a*.

As the developing sleeve 5*a* is rotated, the toner coated on the sleeve 5*a* is sent to the developing portion (developing area) a where the developing sleeve 5*a* is opposed to the photosensitive drum 1. Further, a developing bias voltage is applied to the developing sleeve 5*a* from a developing bias applying power source PS2.

Incidentally, in the illustrated embodiment, the developing bias voltage is a rectangular wave overlapped voltage obtained by overlapping an AC voltage having peak-to-peak voltage of 1600 V and a frequency of 1.8 kHz to DC voltage of −500 V.

In this way, the electrostatic latent image on the photosensitive drum 1 is reversal-developed.

As the printing operation is continued, the amount of the developing pre-mixture tm1 in the developing container is decreased. As the amount of the mixture is decreased, the mixture tm2 in the hopper is supplied to the developing container by rotating a screw 5*d,* thereby adjusting the amount of the developing pre-mixture tm1 in the developing container to a certain range.

In the illustrated embodiment of the present invention, a foreign matter accumulating area (referred to as "paper powder collecting area" hereinafter) as a space for accumulating foreign matter such as paper powder is disposed below the developing sleeve 5*a*.

Now, the paper powder collecting area will be fully described with reference to FIG. 2.

As shown, the developing room (room 1) and the toner room (room 2) as the developer room are interconnected through an opening portion W.

Here, it is assumed that a distance between the center of the cylindrical developing sleeve and the opening portion W is Dr, and a maximum value of a distance between the center of the sleeve and an inner wall of the developing room (room 1) is Er. Er is a distance defining a relationship between the sleeve and the underlying inner wall in the gravity force direction of the sleeve.

When Dr<Er, the paper powder collecting area E within the developing room (room 1), and foreign matter such as paper powder can be accumulated in the paper powder collecting area E. The reason is that, since the developer carried on the developing sleeve 5*a* is substantially included in the distance Dr (range), an exterior of this range forms an area not requiring the carrying of the developer, and, by maintaining such an area, the foreign matter can be accumulated therein without problems.

However, the opening portion W must be positioned within a magnetism constraining range D generated by the magnet roller 5*b*. If the opening portion is positioned out of this range D, the developer is not magnetically absorbed by the magnet roller 5*b* but may be dropped into the paper powder collecting area E.

The developer tm2 in the toner room is supplied to the developing room through the opening portion W positioned within the magnetism constraining range D. As a result, the developer is trapped in the magnetism constraining range D, and an area (paper powder collecting area E) where the developer does not exist is created out of and below the magnetism constraining range D. In this area, the foreign matter such as paper powder are separated from the developer and are successively accumulated.

The magnetism constraining range D is varied with the magnetic pole arrangement of the magnet roller. Here, the range D is defined as a radius of adhesion limit when the developer is adequately adhered to the sleeve including the magnet roller therein.

In particular, the range D is sought from the radius in the angular direction of the opening portion W. In the illustrated embodiment, the range D is selected to about 16 mm.

Next, the toner as the developer and the conductive particles will be described.

(a) Toner

The one-component magnetic toner t as the developer is formed through various steps of mixing binding resin, magnetic particles and charge controlling agent, kneading, grinding and classifying, and conductive particles m and fluidizing agent are added thereto as additive. Incidentally, in the illustrated embodiment, an average particle diameter (D4) of the toner was 7 $\mu$m.

(b) Conductive Particles m

In the illustrated embodiment, conductive zinc oxide particles having specific resistance of $10^6$ Ω·cm and average particle diameter of 3 $\mu$m are used as the conductive particles. The zinc oxide as the conductive particles m is added to the classified toner of 100 parts by weight by an amount of 1 part by weight, and is uniformly dispersed by a mixer, and the resulting mixture is contained in the developing apparatus.

As other materials for the conductive particles m, conductive inorganic particles such as other metal oxide, mixture with organic substance, or particles each surface of which is processed may be used.

Further, since predetermined particle resistance is required to send and receive the charge through the particles, the specific resistance of the particles must be not greater than $10^{12}$ Ω·cm and is preferably not greater than $10^{10}$ Ω·cm.

The resistance was sought by measurement by means of a tablet method and normalization. That is to say, conductive particle specimen (before particles) of 0.5 gram was introduced into a cylinder having a bottom area of 2.26 $cm^2$ and the resistance value was measured by applying pressure of 15 kg onto both upper and lower electrodes and simultaneously applying voltage of 100 V to the electrodes, and, then, normalization of the measured value was effected to calculate the specific resistance.

It is desirable that the particle diameter is not greater than 50 $\mu$m to obtain good charging uniformity. In the illustrated embodiment, the particle diameter of the particles forming condensate is defined as an average particle diameter of the condensate.

In the measurement of the particle diameter, under the observation of the microscope, 100 or more particles are extracted, and volume particle diameter distribution is calculated with maximum horizontal limit length, and the 50% of the average particle diameter thereof is determined as the particle diameter.

The conductive particles may exist not only in a primary particle condition but also in a secondary particle condition (condensate condition). Whatever the type of the condensate may be, so long as the condensate can achieve the function of the conductive particles, any type can be used.

It is desirable that the color of the conductive particles is white or near transparent so as not to obstruct the exposure of the latent image particularly when the particles are used for charging the photosensitive member. Further, in consideration of the fact that the conductive particles may be partially transferred from the photosensitive member to the recording material P, in the color recording, it is desirable that the color of the particles is a noncolor or white.

Further, it is desirable that the particle diameter is smaller than constructural pixel also in order to prevent light scattering due to the particles during the image exposing.. It is considered that, in order to obtain a stable particle condition, the lower limit of the particle diameter is 10 nm.

(4) Existing Amount of Conductive Particles

If an intervening amount of the conductive particles in the contact portion between the photosensitive drum 1 as the image bearing member and the charging roller 2 as the contact charging member is too small, a lubricating effect of the particles cannot be obtained adequately, with the result that friction between the charging roller and the photosensitive member becomes great, which results in the fact that it is difficult to rotate the charging roller 2 with the speed difference regarding the photosensitive drum 1.

Namely, driving torque is increased and, if the charging roller is forcibly rotated, surfaces of the charging roller 2 and the photosensitive drum 1 will be stripped. Further, the increase in contact chance with the particles cannot be expected, thereby not obtaining the adequate charging ability.

On the other hand, if the intervening amount is too great, dropping of the conductive particles from the charging roller 2 is increased, thereby effecting a bad influence upon the image formation.

In the illustrated embodiment, the conductive particles are once supplied onto the photosensitive drum after the transferring by means of conductive particle supplying means, and then, the conductive particles on the drum are scraped by the charging roller, thereby supplying the conductive particles to the charging member.

Accordingly, the conductive particles on the charging member can be controlled to a proper value by an amount of the particles on a coating roller (conductive particle supplying means) and a bias condition between the coating roller and the photosensitive drum.

As a result of tests, it was found that the intervening amount between the charging member and the photosensitive member is $10^3$ particles/mm$^2$ or more. If smaller than $10^3$ particles/mm$^2$, adequate lubricating effect and effect for increasing contact chance cannot be obtained, thereby reducing the charging ability.

More preferably, the intervening amount is desirable to be $10^3$ to $5\times10^5$ particles/mm$^2$. If greater than $5\times10^5$ particles/mm$^2$, the dropping of the particles onto the photosensitive member is greatly increased, with the result that poor exposure to the photosensitive member occurs regardless of light permeability of the particle itself. If not greater than $5\times10^5$ particles/mm$^2$, the amount of dropped particles is reduced, thereby improving a bad influence.

On the other hand, after passed through the conductive particle supplying means, the conductive particles of $10^2$ to $10^5$ particles/mm$^2$ is coated on the photosensitive member. More preferably, it is desirable to supply the conductive particles of $10^3$ to $10^4$ particles/mm$^2$.

Further, since it was found that an existing amount of particles dropped on the photosensitive drum after the charging is $10^2$ to $10^5$ particles/mm$^2$, it is desirable that the existing amount which does not effect a bad influence is not greater than $10^5$ particles/mm$^2$.

Now, the intervening amount and the existing amount on the photosensitive member will be explained. Regarding the intervening amount, although it is desirable that the contact portion between the charging roller and the photosensitive member is directly measured, since major part of the particles existing on the photosensitive member before contacting with the charging roller is scraped by the charging roller which is contacted with the photosensitive member while rotating in the opposite direction, in the illustrated embodiment, the amount of the particles on the charging roller immediately before the charging roller reaches the contact portion is defined as the intervening amount.

More specifically, after the photosensitive member and the charging roller were stopped in a condition that the charging bias was not applied, the surfaces of the photosensitive member and the charging roller were photo-taken by a video microscope (OVM 1000N manufactured by OLYMPUS Co., Ltd.) and a digital still recorder (SR-3100 manufactured by DELTIS Inc.).

Regarding the charging roller, the charging roller was contacted with a slide glass in the same condition that it is urged against the photosensitive member, and the contact surface was photo-taken from a back surface of the slide glass by means of a video microscope having an objective lens of 1000 magnifications. In order to obtain area separation of individual particle from the obtained image, the image was binary-processed by using a certain threshold, and the number of areas where the particles exist was measured by using desired image processing software.

Further, also as for the existing amount on the photosensitive member, the photosensitive member was photo-taken by the similar video microscope, and the existing amount was measured by the similar processes.

(5) Direct Injection Charging

The mixture tm of toner and conductive particles contained in the developing apparatus 5 is transferred onto the photosensitive drum 1 by an appropriate amount during the toner development of the electrostatic latent image on the photosensitive drum 1.

The toner image on the photosensitive drum 1 is pulled and positively shifted toward the transfer material P under the influence of the transfer bias in the transfer nip portion b. In this case, since the conductive particles m on the photosensitive drum 1 are conductive although they are positively shifted toward the transfer material P, some of them remain to be substantially adhered to and held on the photosensitive drum 1.

Further, due to the presence of the conductive particles m substantially adhered to and held on the photosensitive drum 1, the transferring efficiency for transferring the toner image from the photosensitive drum 1 to the transfer material P is enhanced.

Since the image recording apparatus of toner recycle process type does not use a cleaner, the residual toner and the residual conductive particles remaining on the surface of the photosensitive drum 1 after the transferring are, as they are, brought to the contact charging portion n between the photosensitive drum 1 and the charging roller 2 as the contact charging member by the rotation of the photosensitive drum 1 and are adhered to the charging roller 2.

Accordingly, the contact charging of the photosensitive drum 1 is effected in a condition that the conductive particles m exist in the contact portion n between the photosensitive drum 1 and the charging roller 2. Incidentally, in the initial phase of the printing, since the conductive particles are not supplied to the surface of the charging roller and thus the charging cannot be effected, the conductive particles may previously be coated on the surface of the charging roller.

Due to the presence of such conductive particles m, even when the toner is adhered to the charging roller 2, since the tight contacting ability of the charging roller 2 with the photosensitive drum 1 and the good contact resistance can be maintained, regardless of the fact that the contact charging member is a simple member such as the charging roller and the charging roller is contaminated by the residual toner, the direct injection charging from the charging roller 2 to the photosensitive drum 1 can be achieved.

Namely, since the charging roller 2 is closely contacted with the photosensitive member with the interposition of the conductive particles m and the conductive particles m existing in the contact portion between the charging roller 2 and the photosensitive drum 2 are slidingly contacted with the surface of the photosensitive drum without any space, in the charging of the photosensitive drum 1 by means of the charging roller 2, the stable and safe direct injection charging not utilizing discharge phenomenon becomes preferential, and high charging efficiency which would not be obtained by normal roller charging can be achieved, with the result that potential substantially the same as that applied to the charging roller 2 can be given to the photosensitive member.

Further, the transfer-residual toner adhered to the charging roller 2 is gradually shifted from the charging roller 2 to the surface of the photosensitive drum 2 and is brought to the developing portion, where the toner is collected by the cleaning (collecting) simultaneous with developing in the developing apparatus 5 (toner recycle process).

As mentioned above, in the cleaning simultaneously with developing, the residual toner remaining on the photosensitive drum 1 after the transferring is collected by the fog removal bias, i.e., fog removal potential difference Vback (potential difference between the voltage applied to the developing apparatus and the surface potential of the photosensitive member) during the developing in the subsequent image formation (in which the photosensitive member is subsequently charged and is exposed to form a latent image which is in-turn developed).

In case of the reversal developing in the printer according to the illustrated embodiment, the cleaning simultaneous with developing is effected by the action of an electrical field for collecting toner from a dark potential portion of the photosensitive member to the developing sleeve and an electrical field for adhering toner from the developing sleeve to a bright potential portion of the photosensitive member.

Further, even if the conductive particles are dropped from the charging roller 2, when the image recording apparatus is operated, since the conductive particles m included in the developing pre-mixture in the developing apparatus 5 is shifted to the surface of the photosensitive drum 1 in the developing portion a and then is brought to the contact charging portion n through the transfer nip portion and is successively replenished to the charging roller by the rotation of the photosensitive drum 1, the good charging ability due to the presence of the conductive particles m can be maintained stably.

In this way, in the image recording apparatus of direct injection charging type, transfer type and toner recycle process type, regardless of the fact that the charging roller is used as the contact charging member and the charging roller 2 is contaminated by the residual toner, the direct injection charging can stably be maintained for a long term with low applied voltage and without ozone, uniform charging ability ca be achieved, and an image recording apparatus having good image quality, which does not cause poor charging due to ozone products can be obtained with simple construction and low cost.

Further, by existing the conductive particles in the contact portion n between the charging roller 2 and the photosensitive drum 1, the speed difference can easily be created effectively between the charging roller 2 and the photosensitive drum 1 by the lubricating effect (friction reducing effect) of the conductive particles m.

By providing the speed difference between the charging roller 2 and the photosensitive drum 1, the chance for contacting the conductive particles m with the photosensitive drum 1 in the contact portion n between the charging roller 2 and the photosensitive drum 1 is greatly increased, with the result that high contacting ability can be obtained, thereby permitting the direct injection charging easily.

As an arrangement for providing the speed difference, preferably, in order to temporarily collect the residual toner on the photosensitive drum 1 brought to the contact portion n onto the charging roller 2, it is desirable that the charging roller 2 is rotated in a direction opposite to a shifting direction of the surface of the photosensitive drum 1.

That is to say, by the opposite direction rotation, the residual toner on the photosensitive drum 1 is temporarily separated and then the charging is effected, with the result tat the direct injection charging can be effected advantageously.

(Second Embodiment)

Figure 3:
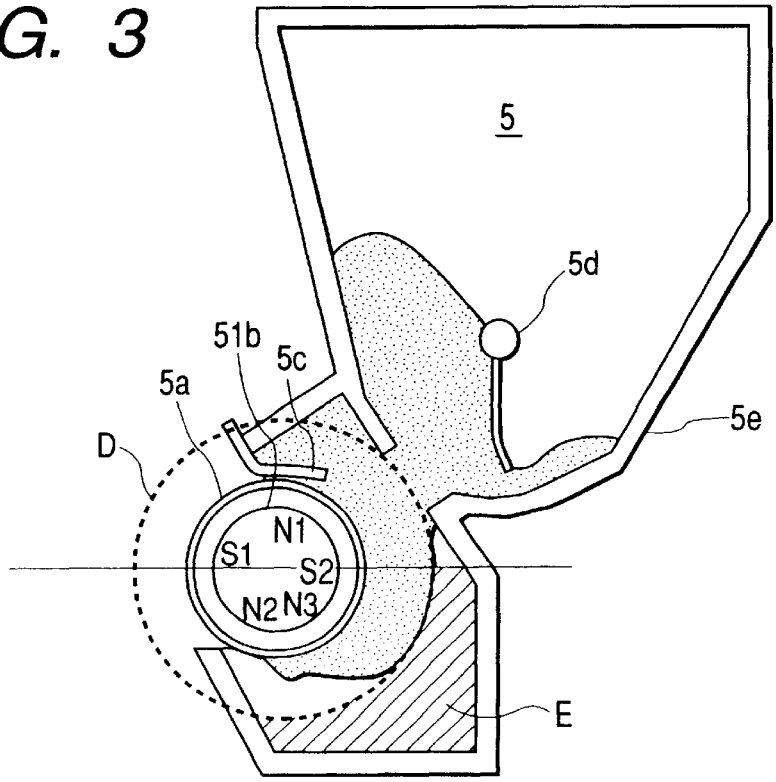
FIG. 3 is a schematic constructural view of a developing apparatus according to a second embodiment of the present invention.

FIG. 3 shows a second embodiment of the present invention. In this second embodiment, in addition to the arrangement of the first embodiment, as a separating mechanism for positively separating foreign matter (such as paper powder) mixed into the developer, an arrangement in which magnetic poles having a same polarity are provided for adjusting the magnetic field.

Since the other constructions and functions are the same as those in the: first embodiment, the same elements as those in the: first embodiment are designated by the same reference numerals and explanation thereof will be omitted.

FIG. 3 is a schematic constructural view of a developing apparatus according to the second embodiment of the present invention.

The developing apparatus includes a rotatable nonmagnetic developing sleeve 5*a* as a developer carrying member having a magnet roller 51*b* therein, and, while developer t and conductive particles m in a developing device are being carried on the rotating developing sleeve 5*a,* they are formed as a developer layer a thickness of which is regulated by a regulating blade 5*c* and are applied a charge.

The magnet roller 51*b* constitutes a magnet roll having repulsive poles S1, S2, N1, N2, and N3 (adjacent same polarity magnetic poles) disposed in a foreign matter accumulating area (gravity force direction).

With this arrangement, since the holding force for the developer by the repulsive poles is greatly changed, the developer carried on the sleeve is carried in a discontinuous manner, with the result that the foreign matter such as the paper powder mixed into the developer can be separated positively and efficiently.

Accordingly, the quality of the developer can be maintained.

Incidentally, the condition of the developing bias voltage and prescription of the toner t and the conductive particles m are the same as those in the first embodiment.

(Third Embodiment)

Figure 4:
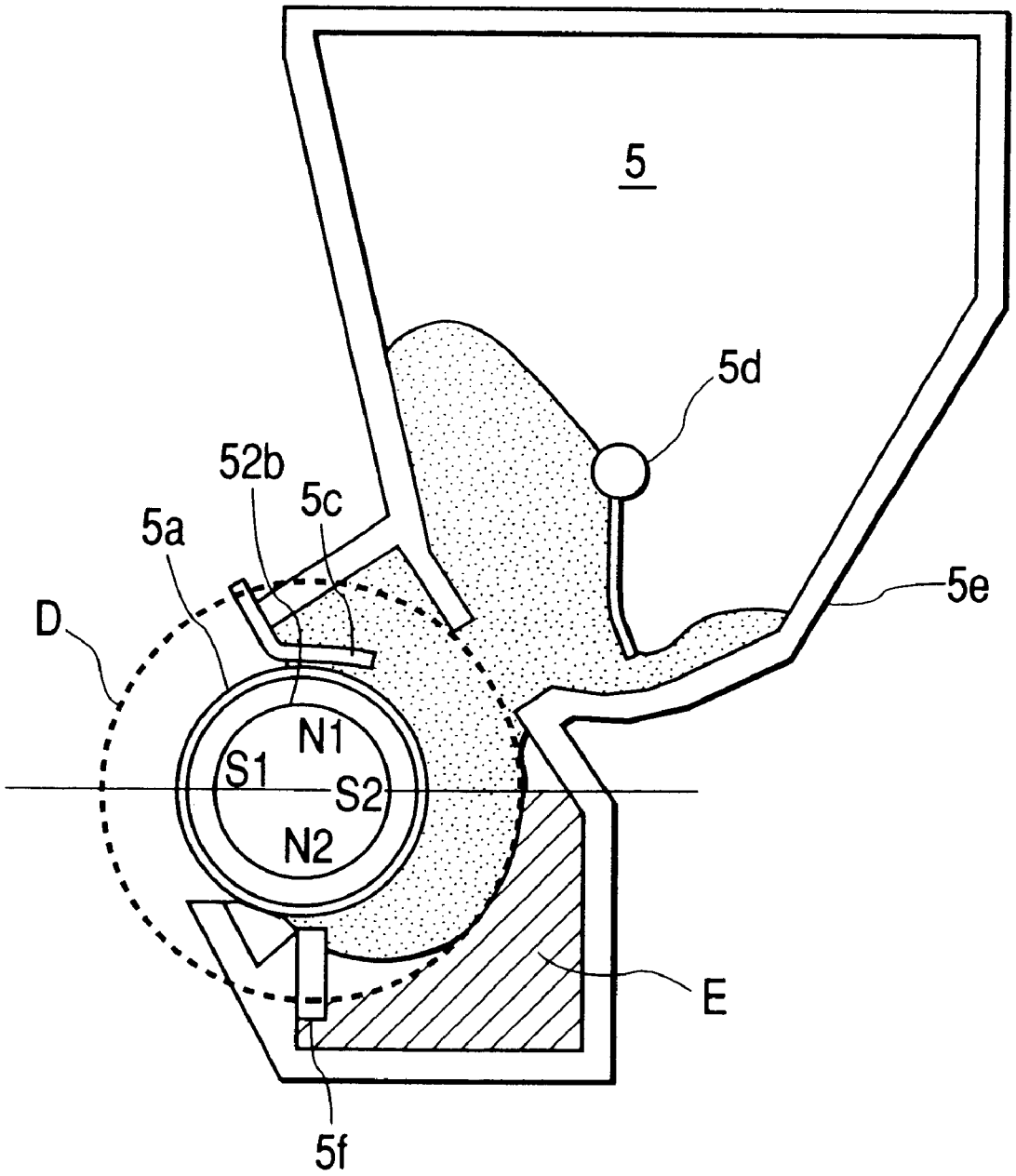
FIG. 4 is a schematic constructural view of a developing apparatus according to a third embodiment of the present invention.

FIG. 4 shows a third embodiment of the present invention. In the third embodiment, in addition to the arrangement of the first embodiment, as a separating mechanism for positively separating foreign matters (such as paper powder) mixed into the developer, an arrangement in which a magnetic blade is provided for adjusting the magnetic field.

Since the other constructions and functions are the same as those in the first embodiment, the same elements as those in the first embodiment are designated by the same reference numerals and explanation thereof will be omitted.

FIG. 4 is a schematic constructural view of a developing apparatus according to the third embodiment of the present invention.

The developing apparatus includes a rotatable nonmagnetic developing sleeve 5*a* as a developer carrying member having a magnet roller 52*b* therein, and, while developer t and conductive particles m in a developing device are being carried on the rotating developing sleeve 5*a,* they are formed as a developer layer a thickness of which is regulated by a regulating blade 5*c* and are applied a charge.

A magnetic cut blade (magnetic blade) 5*f* is constituted by a magnetic plate and is magnetized by an N2 pole of a magnet 52*b,* thereby generating an uneven magnetic field thereabout. Consequently, the developer carried on the sleeve becomes upright (forming chains), with the result that the foreign matter such as paper powder included in the developer can be separated positively and efficiently.

Accordingly, the quality of the developer can be maintained.

Incidentally, the condition of the developing bias voltage and prescription of the toner t and the conductive particles m are the same as those in the first embodiment.

(Fourth Embodiment)

Figure 5A:
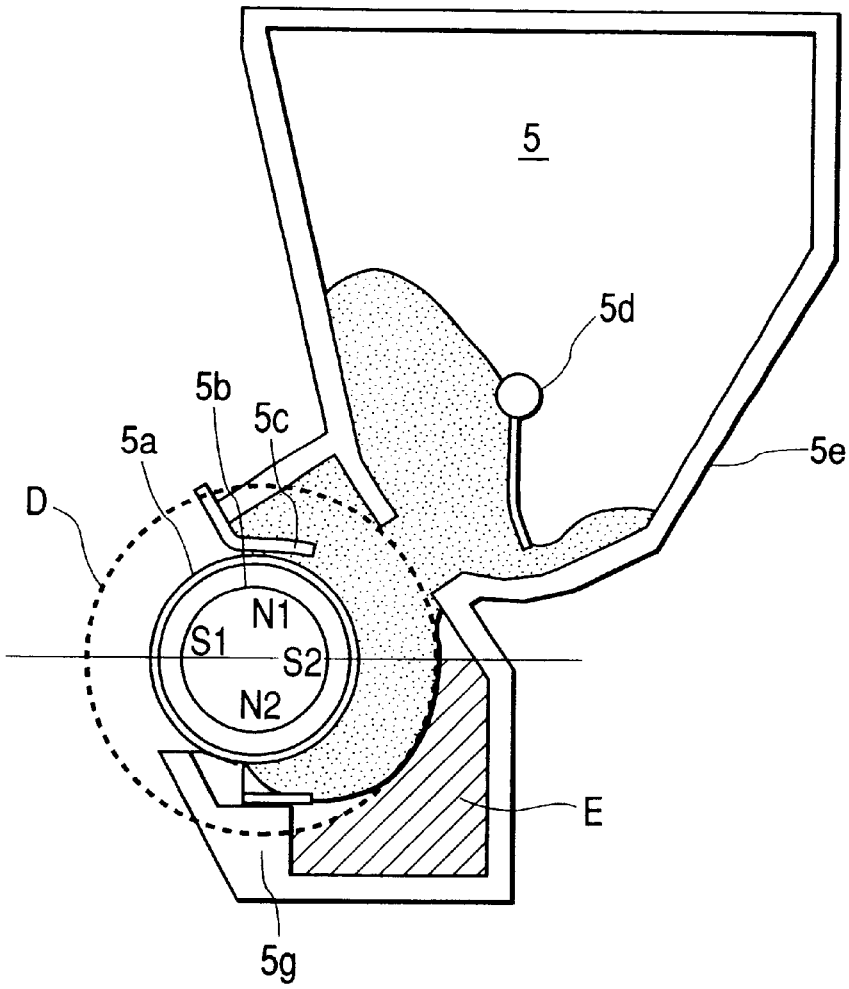
FIGS. 5A and 5B are schematic constructural views of a developing apparatus according to a fourth embodiment of the present invention.
Figure 5B:
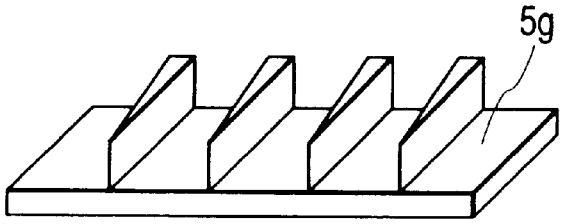

FIGS. 5A and 5B show a fourth embodiment of the present invention. In the fourth embodiment, in addition to the arrangement of the first embodiment, as a separating mechanism for positively separating foreign matter (such as paper powder) mixed into the developer, an arrangement in which an agitating member is provided for agitating the developer to be carried.

Since the other constructions and functions are the same as those in the first embodiment, the same elements as those in the first embodiment are designated by the same reference numerals and explanation thereof will be omitted.

FIGS. 5A and 5B are schematic constructural views of a developing apparatus according to the fourth embodiment of the present invention, where FIG. 5A is an entire schematic constructural view, and FIG. 5B is a schematic constructural perspective view of developer agitating vanes of an agitating member.

The developing apparatus includes a rotatable nonmagnetic developing sleeve 5*a* as a developer carrying member having a magnet roller 5*b* therein, and, while developer t and conductive particles m in a developing device are being carried on the rotating developing sleeve 5*a,* they are formed as a developer layer a thickness of which is regulated by a regulating blade 5*c* and are applied a charge.

Agitating vanes 5*g* of an agitating member serve to agitate the developer carried on the developing sleeve to facilitate removal of the foreign matter such as paper powder existing in the developer, with the result that the foreign matter can be separated positively and efficiently.

Accordingly, the quality of the developer can be maintained.

Incidentally, the condition of the developing bias voltage and prescription of the toner t and the conductive particles m are the same as those in the first embodiment.

(Fifth Embodiment)

Figure 6:
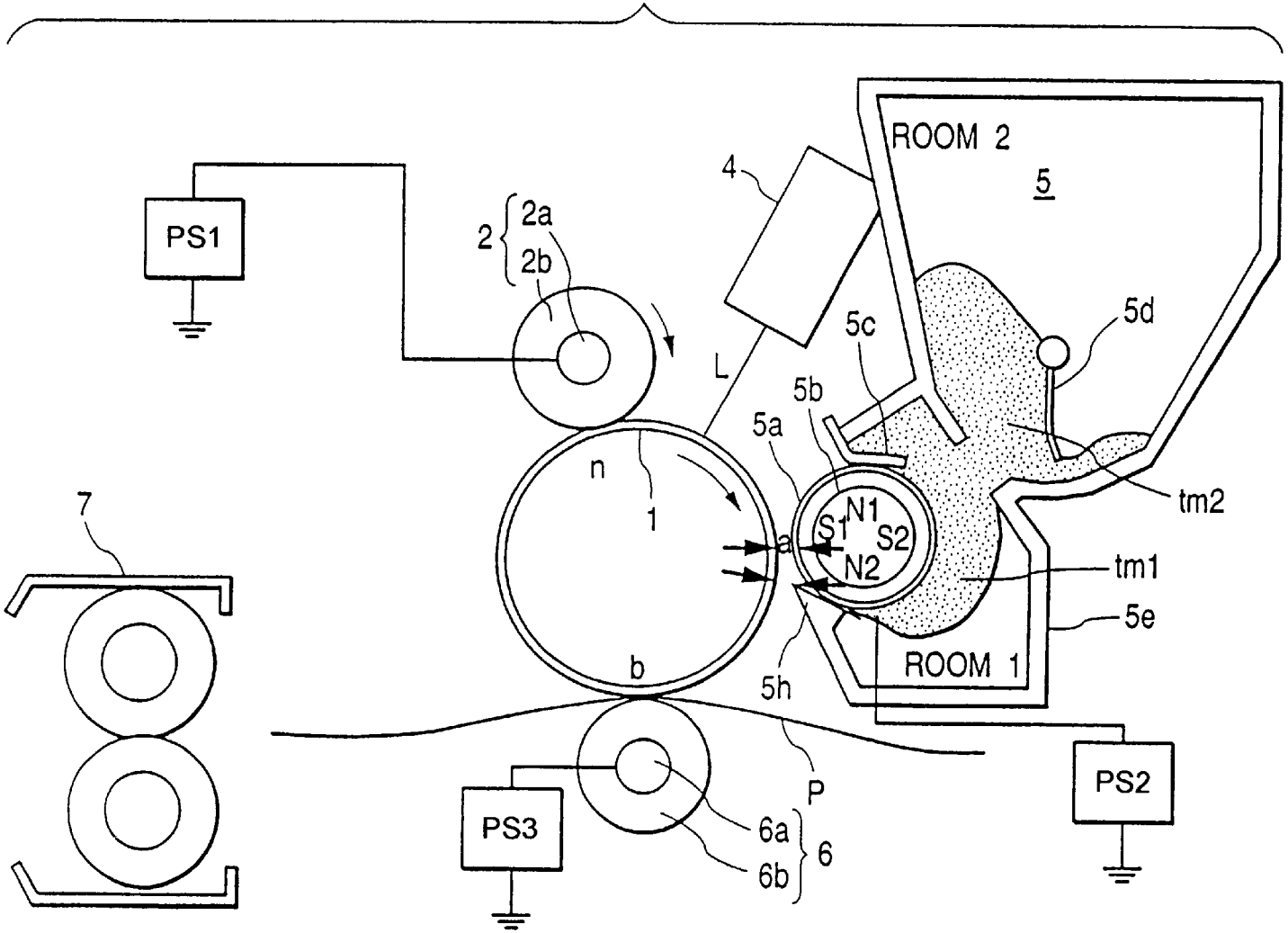
FIG. 6 is a schematic constructural view of an image recording apparatus according to a fifth embodiment of the present invention.

FIG. 6 shows a fifth embodiment of the present invention. In the fifth embodiment, in addition to the arrangement of the first embodiment, there is provided a scraping member for scraping foreign matter from a member to be developed (photosensitive drum).

Since the other constructions and functions are the same as those in the first embodiment, the same elements as those in the first embodiment are designated by the same reference numerals and explanation thereof will be omitted.

FIG. 6 is a schematic constructural view of a developing apparatus according to the fifth embodiment of the present invention.

In order to collect the foreign matters such as paper powder on the photosensitive drum 1, a scraper 5*h* as a scraping member is provided. A distance between the scraper 5*h* and the photosensitive drum 1 is selected to be substantially the same as the distance between the photosensitive drum 1 and the sleeve 5*a*.

Incidentally, in this embodiment, the distance is selected to be 300 $\mu$m. With this arrangement, the foreign matter such as paper powder existing on the photosensitive drum 1 can be collected into the developing device positively and can be accumulated in the foreign matter accumulating area provided below the developing room (room 1) of the developing device.

Incidentally, the condition of the developing bias voltage and prescription of the toner t and the conductive particles m are the same as those in the first embodiment.

(Sixth Embodiment)

Figure 7:
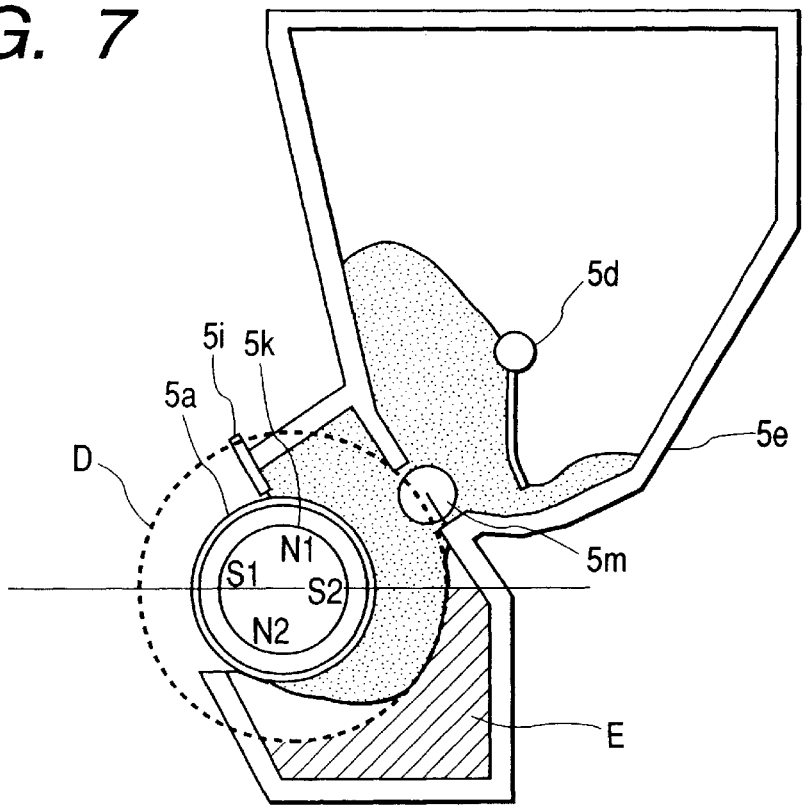
FIG. 7 is a schematic constructural view of a developing apparatus according to a sixth embodiment of the present invention.

FIG. 7 shows a sixth embodiment of the present invention. In the first embodiment, while an example that one-component developer is used as the developer was explained, in the sixth embodiment, an example that two-component developer is used will be explained.

Since the fundamental constructions and functions are the same as those in the first embodiment, the same elements as those in the first embodiment are designated by the same reference numerals and explanation thereof will be omitted.

FIG. 7 is a schematic constructural view of a developing apparatus according to the sixth embodiment of the present invention.

In this sixth embodiment, the developing apparatus utilizes two-component developer. Magnetic carrier comprised of ferrite particles and mixture of nonmagnetic toner and conductive particles are contained within the developing room, and toner and conductive particles are accumulated within the toner room.

The agents (contents) in the toner room are replenished intermittently by a supplying screw 5*m*.

Also in this embodiment, a collecting area disposed below a developing sleeve 5*a* is effective and can collect foreign matter such as paper powder. In the arrangement according to this embodiment, although the toner and the conductive particles are not magnetic, they possess electrostatic force and weak adhering force while being frictionally charged together with the magnetic carrier, thereby permitting separation of the paper powder (foreign matter).

Next, several comparative examples will be explained in order to ascertain the effects of the developing apparatuses or the image recording apparatuses according to the above-mentioned embodiments.

Comparative Example 1

Figure 10:
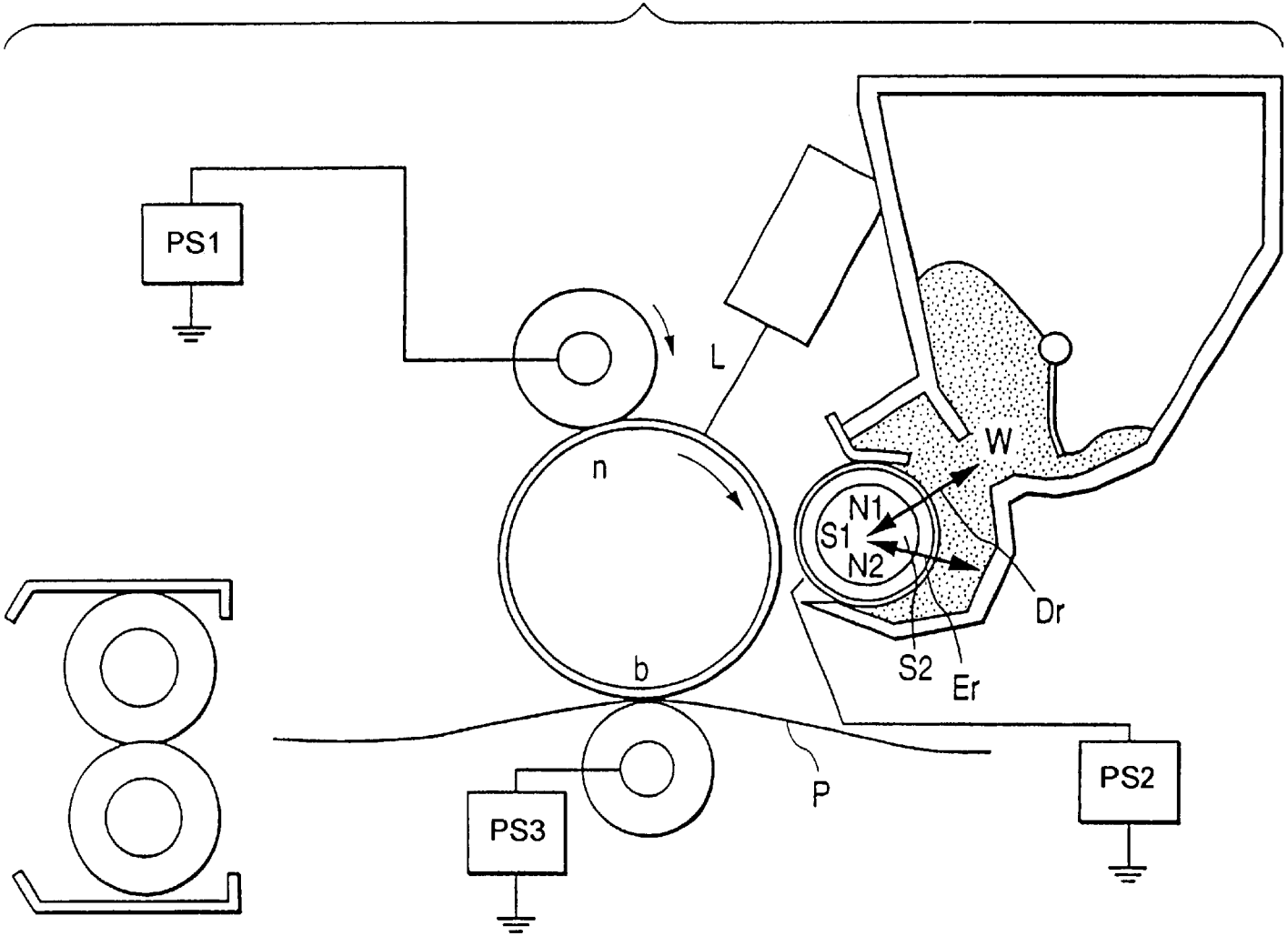
FIG. 10 is a schematic constructural view of an image recording apparatus according to a comparative example 1.

In a comparative example 1, as shown in FIG. 10, the distance Dr between the center of the sleeve and the opening portion is the same as the maximum value Er of the distance between the center of the sleeve and the inner wall of the developing room 1, and, thus, the developing device has a developing room having no cavity (foreign matter accumulating area). The other constructions are fundamentally the same as those in the first embodiment.

Comparison Example 2

In a comparative example 2, the distance Dr between the center of the sleeve and the opening portion is the same as the maximum value Er of the distance between the center of the sleeve and the inner wall of the developing room 1, and, thus, the developing device has a developing room having no cavity (foreign matter accumulating area). Further, a magnet roller has repulsive poles. The other constructions are fundamentally the same as those in the second embodiment.

Comparative Example 3

In a comparative example 3, the distance Dr between the center of the sleeve and the opening portion is the same as the maximum value Er of the distance between the center of the sleeve and the inner wall of the developing room 1, and, thus, the developing device has a developing room having no cavity (foreign matter accumulating area). Further, a developing apparatus utilizes two-component developer. The constructions are fundamentally the same as those in the sixth embodiment.

[Estimation Result]

A table shown in FIG. 11 represents estimation results of the various embodiments of the present invention and the comparative examples and indicates validity of the present invention.

(a) Change in Image Density

A minimum value of image density in a page obtained when the solid black is recorded was measured by a reflection densitometer. Various measured values are shown in the Table.

(b) Uniformity of Intermediate Color Image (Image Uniformity)

Figure 8:
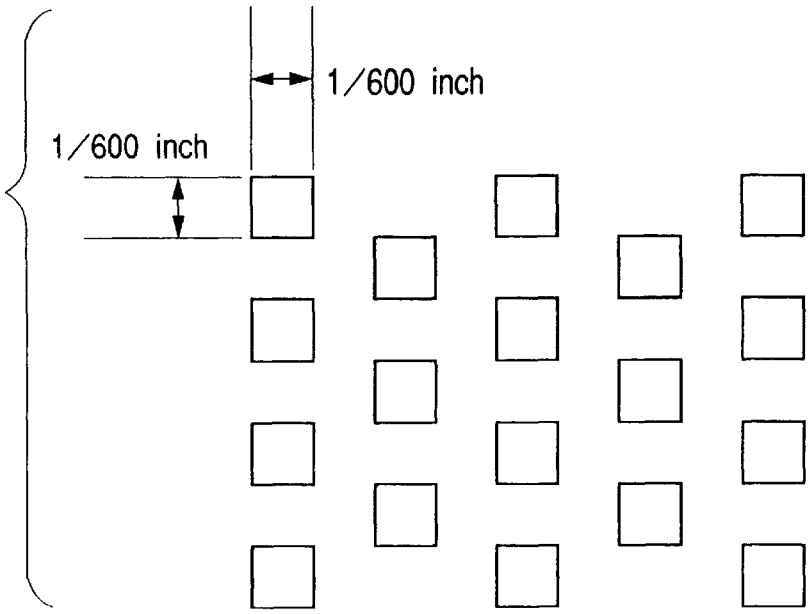
FIG. 8 is a view showing an estimation image pattern.

In recording resolving power of 600 dpi, binary-value images as shown in FIG. 8 were recorded and uniformities thereof were estimated relatively. Regarding the estimation, the following references were used:

A: dot-like density unevenness can almost not be observed (0 to 1 point/$cm^2$)

B: dot-like density unevenness can be observed (2 to 3 points/$cm^2$)

C: dot-like density unevenness is noticeable (4 or more points/$cm^2$)

(c) Existing amount of paper powder on sleeve Remaining amount of paper powder were estimated by using the following references:

A: fibrous paper powder can almost not be observed (0 to 1 point/$cm^2$)

B: fibrous paper powder can be observed (2 to 3 points/$cm^2$)

C: fibrous paper powder is noticeable (4 or more points/$cm^2$)

Further, the estimation was performed from initial print to after 4000 sheets (4 k). Regarding the above (b) and (c), the estimation was performed only after 4000 sheets. Incidentally, the print tests were conducted with printing ratio of image pattern of5% and by using a pattern in which there is no difference in printing ratio in a longitudinal direction.

On the basis of the above-mentioned estimation results, validity of the embodiments of the present invention will be described.

First of all, in the comparative example 1, the distance Dr is the same as the maximum value Er and the developing room (room 1) is filled with the developer. Accordingly, the paper powder entered into the developer in the developing nip is collected into the developing device, with the result that the developing ability is worsened.

As a result, the image density is reduced, and, regarding the image uniformity, the dot-like density unevenness is generated. Further, by observing the sleeve, it was found that mixing of fibrous paper powder is ascertained.

On the other hand, in the first embodiment, the maximum value is greater than the distance Dr, with the result that the amount of toner supplied from the opening portion is suppressed below Dr and the paper powder collecting area E is formed below the sleeve.

As a result, the paper powder adhered to the sleeve is carried on the sleeve and is accumulated into the paper powder collecting area E. Thus, the reduction in image density can be suppressed, and good results regarding the image uniformity and the paper powder amount on the sleeve can be obtained.

Further, in the second embodiment, by providing the repulsive poles in the opposed relationship to the cavity (paper powder collecting area E), the developer is carried on the sleeve discontinuously so that the paper powder included in the developer can be separated more efficiently.

However, in the comparative example 2, even if repulsive poles are arranged in the same manner, since there is no effective cavity below the sleeve, the paper powder cannot be accumulated. As a result, the image density is reduced and the image uniformity is worsened.

Namely, in the embodiments of the present invention, the arrangement in which the developing device has a relationship Dr<Er to create the space below the sleeve is inevitable for removing the foreign matters such as paper powder.

Further, in order to remove the foreign matter such as paper powder, by providing the separating mechanism for separating the foreign matter such as paper powder, the foreign matter such as paper powder can be removed more efficiently.

Incidentally, as mentioned above, in the third embodiment, the magnetic blade is disposed as the separating mechanism opposed to the lower pole of the sleeve to effect the magnetic cut thereby to remove the paper powder in the developer, and, in the fourth embodiment, the non-magnetic auxiliary means for agitating the developer to facilitate the separation of the paper powder from the developer is provided below the sleeve as the separating mechanism. In this way, good results could be obtained.

Further, in the fifth embodiment, by adopting the arrangement in which the lower collecting portion of the container of the developing device is disposed adjacent to the photosensitive drum 1 to collect and remove the paper powder on the photosensitive drum, the paper powder can be prevented from scattering on the photosensitive drum, and, thus, the image uniformity can be enhanced.

Further, the conductive particles are mixed into the developer together with the toner and are remained on the image bearing member together with the toner as the residual matters and then are supplied to the charging roller. In order to continue the supplying of the conductive particles stably, the developing container must supply the developer through the opening portion by a small amount. This is effective as a method for remove the paper powder efficiently without removing the conductive particles.

Further, it is desirable that the conductive particles have frictional charging polarity opposite to the polarity of the developer so that the toner is pulled toward each other by the electrostatic force and weak adhering force. In this case, the separation by means of mesh is not desirable and makes the construction itself complicated, thereby resulting in cost disadvantage. Further, in the sixth embodiment and the comparative example 3, when two-component developer is used, by adopting the arrangement according to the present invention, the demerit due to the paper powder can be suppressed.

As mentioned above, in the embodiments of the present invention, the injection charging having no demerit due to the discharging and the economical merit due to cleanerless are compatible, and the poor image formation due to the foreign matter such as paper powder can be improved.

[Others]

In the embodiments of the present invention, when a foam body is provided or when a valve is provided in accordance with the configuration of the container to prevent reverse flow of the paper powder accumulated in the paper powder collecting area E, further preferable result can be obtained.

Further, it is preferable that a charge injecting layer is provided on the surface of the photosensitive drum 1 to adjust the resistance of the surface of the photosensitive member.

Figure 9:
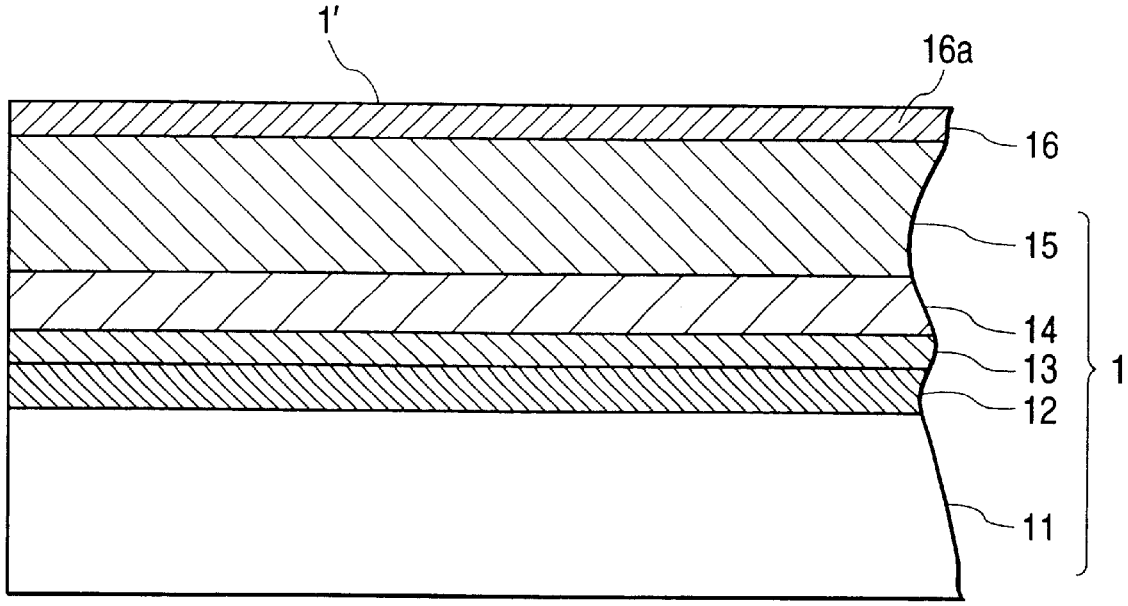
FIG. 9 is a schematic view showing a layer structure of a photosensitive member having a charge coupling/layer at its surface.

In this regard, for example, a case were a photosensitive member having negative polarity is used will be explained with reference to FIG. 9. FIG. 9 is a schematic view of a layer structure of a photosensitive drum 1' having a charge injecting layer thereon.

That is to say, in the photosensitive drum 1', by coating a charge injecting layer 16 on a standard organic photosensitive drum 1 constituted by successively coating an under layer 12, a positive charge injection preventing layer 13, a charge generating layer 14 and a charge transporting layer 15 on an aluminum base substrate (aluminum drum substrate) 11, a charging ability is enhanced.

The charge injecting layer 16 is formed by mixing and dispersing $SnO_2$ super fine particles (having a diameter of about 0.03 $\mu$m) as conductive particles (conductive filler) and polymerization starting agent in light-curable acrylic resin as binder and by then coating it and then by effecting film formation by means of a light curing method.

In addition, by including lubricant such as polytetrafluoroethylene (Teflon) resin, surface energy on the surface of the drum is suppressed, thereby totally suppressing adhesion of the conductive particles onto the charging roller.

The important matter as the charge injecting layer 16 is surface resistance. In a charging system using direct charge injection, by reducing the resistance of the member to be charged, sending and receiving of charges can be effected more efficiently.

On the other hand, when the charge injecting layer is used with the photosensitive member, since the electrostatic latent image must be held for a predetermined time period, the specific resistance of the charge injecting layer 16 may be selected to a range from $1\times10^{9}$ to $1\times10^{14}$ ($\Omega\cdot$cm).

Further, as is in the embodiments, even when the charge injecting layer 16 is not used, for example, if the charge transporting layer 15 has resistance having the above-mentioned range, the same effect can be obtained. Further, even when amorphous silicon photosensitive body having surface specific resistance of about $10^{13}$ $\Omega\cdot$cm is used, the similar effect can be obtained.

As mentioned above, while the embodiments of the present invention were explained, the present invention is not limited to such embodiments, but various alterations and modifications can be made within the scope of the invention.

What is claimed is:

1. A developing apparatus comprising:

a developing container;

a toner carrying member provided at an opening portion of said developing container and adapted to carry toner; and a toner container disposed adjacent to said developing container, said toner container including a replenishing opening portion for replenishing said developing container with the toner;

wherein said toner container has a space portion which disposed below said toner carrying member and which is not substantially replenished with the toner, wherein the toner is magnetic and said toner carrying member has a magnet member, and wherein a maximum distance between a rotation center of said toner carrying member and an inner wall of said space portion to which said toner carrying member is opposed is greater than a distance between a rotation center of said toner carrying member and said replenishing opening portion of said toner container.

2. A developing apparatus according to claim 1, wherein a foreign matter entered through the opening portion is dripped into the space portion.

3. A developing apparatus according to claim 1, further comprising separating means for separating a foreign matter mixed into the toner on said toner carrying member from the toner.

4. A developing apparatus according to claim 3, wherein said separating means has an agitating member for agitating the toner on said toner carrying member.

5. A developing apparatus according to claim 1, wherein said developing apparatus is used with an image forming apparatus which does not have a cleaner for cleaning an image bearing member, and develops an electrostatic latent image on said image bearing member while collecting a residual toner.

6. A developing apparatus according to claim 1, wherein said replenishing opening portion is provided above the rotation center of said toner carrying member.

7. A developing apparatus comprising:

a developing container;

a toner carrying member provided at an opening portion of said developing container and adapted to carry toner; and a toner container disposed adjacent to said developing container, said toner container including a replenishing opening portion for replenishing said developing container with the toner;

wherein said developing container has a space portion which is disposed below said toner carrying member and which is not substantially replenished with the toner, wherein the toner is magnetic and said toner carrying member has a magnet member, wherein a maximum distance between a rotation center of said toner carrying member and an inner wall of said space portion to which the toner carrying member is opposed is greater than a distance between the rotation center of said toner carrying member and the replenishing opening portion of said toner container, and wherein said magnet member has a repulsive magnetic field portion at a lower part thereof.

8. A developing apparatus comprising:

a developing container;

a toner carrying member provided at an opening portion of said developing container and adapted to carry toner;

a toner container disposed adjacent to said developing container, and adapted to replenish said developing container with the toner;

wherein said developing container has a space portion which is disposed below said toner carrying member and which is not substantially replenished with the toner, wherein the toner is magnetic and said toner carrying member has a magnet member, and a magnetic blade opposed to a lower part of said toner carrying member.

* * * * *

UNITED STATES PATENT AND TRADEMARK OFFICE

CERTIFICATE OF CORRECTION

PATENT NO. : 6,466,758 B2
DATED : October 15, 2002
INVENTOR(S) : Yasunori Chigono et al.

It is certified that error appears in the above-identified patent and that said Letters Patent is hereby corrected as shown below:

Column 1,
Line 29, “simultaneous” should read -- simultaneously --.

Column 4,
Line 67, “foam, thereof.” should read -- foam thereof. --.

Column 7,
Line 31, “exposing..” should read -- exposing. --.

Column 9,
Lines 49 and 62, “simultaneous” should read -- simultaneously --;
Line 60, “in-turn” should read -- in turn --; and Column 10,
Line 45, “tat” should read -- that --;
Lines 55 and 56, “the:” should read -- the --.

Column 14,
Line 11, “of5%” should read -- of 5% --; and
Line 51, “matters” should read -- matter --.

Column 15,
Line 7, “are remained” should read -- remain --;
Line 13, “remove” should read -- removing --; and
Line 28, “to cleanerless” should read -- to being cleanerless --.

UNITED STATES PATENT AND TRADEMARK OFFICE

CERTIFICATE OF CORRECTION

PATENT NO. : 6,466,758 B2
DATED : October 15, 2002
INVENTOR(S) : Yasunori Chigono et al.

It is certified that error appears in the above-identified patent and that said Letters Patent is hereby corrected as shown below:

Column 16,
Line 26, "which" should read -- which is --.

Signed and Sealed this

Second Day of December, 2003

JAMES E. ROGAN
*Director of the United States Patent and Trademark Office*